US012208949B2

(12) United States Patent
Miller et al.

(10) Patent No.: US 12,208,949 B2
(45) Date of Patent: Jan. 28, 2025

(54) MASON CONTAINER LID

(71) Applicant: SUPERB SEALING SOLUTIONS, LLC, Sugarcreek, OH (US)

(72) Inventors: John Miller, Sugarcreek, OH (US); Daniel Miller, Sugarcreek, OH (US); Matteo Rini, Dover, OH (US); Lee Heilman, Sugarcreek, OH (US); Lakin Phillips, Conesville, OH (US)

(73) Assignee: SUPERB SEALING SOLUTIONS, LLC, Sugarcreek, OH (US)

( * ) Notice: Subject to any disclaimer, the term of this patent is extended or adjusted under 35 U.S.C. 154(b) by 63 days.

(21) Appl. No.: 18/324,448

(22) Filed: May 26, 2023

(65) Prior Publication Data

US 2023/0303295 A1 Sep. 28, 2023

Related U.S. Application Data

(63) Continuation-in-part of application No. 17/655,567, filed on Mar. 21, 2022, now Pat. No. 11,697,533.
(Continued)

(51) Int. Cl.
*B65D 51/16* (2006.01)
*B65D 43/02* (2006.01)
(Continued)

(52) U.S. Cl.
CPC ..... *B65D 51/1605* (2013.01); *B65D 43/0202* (2013.01); *B65D 45/30* (2013.01);
(Continued)

(58) Field of Classification Search
CPC .... B65D 39/02; B65D 39/025; B65D 51/145; B65D 51/14; B65D 53/02; B65D 2543/00037; B65D 2543/00981; B65D 41/0414; B65D 41/0428; B65D 41/0442; B65D 55/0845; B65D 55/0863;
(Continued)

(56) References Cited

U.S. PATENT DOCUMENTS 2,008,593 A * 7/1935 Pedersen ..... B65D 51/145 215/276
2,319,849 A * 5/1943 Thorne ..... B65D 41/045 220/288

(Continued)

*Primary Examiner* — Kareen K Thomas
(74) *Attorney, Agent, or Firm* — James D. Miller; Shumaker, Loop & Kendrick, LLP

(57) ABSTRACT

A lid assembly includes a lid element having an annularly shaped peripheral portion configured to be axially aligned with and disposed between a rim of a canning container and a radially extending portion of a retainer element when the lid assembly is engaging the canning container and the retainer element is removably coupled to the canning container. An annularly shaped sealing element is disposed on the peripheral portion of the lid element and is configured to directly engage the rim of the canning container when the lid assembly is contacting the canning container. A plurality of projections is formed in the peripheral portion of the lid element with each of the projections forming a distally disposed surface of the peripheral portion with respect to an exterior axial direction of the lid element extending away from an interior of the canning container when the lid assembly is engaging the rim.

16 Claims, 7 Drawing Sheets

Related U.S. Application Data

(60) Provisional application No. 63/164,208, filed on Mar. 22, 2021.

(51) Int. Cl.
*B65D 45/30* (2006.01)
*B65D 53/02* (2006.01)

(52) U.S. Cl.
CPC ..... *B65D 53/02* (2013.01); *B65D 2205/00* (2013.01); *B65D 2251/205* (2013.01); *B65D 2543/00037* (2013.01); *B65D 2543/00092* (2013.01); *B65D 2543/0024* (2013.01); *B65D 2543/00277* (2013.01); *B65D 2543/00537* (2013.01); *B65D 2543/00564* (2013.01)

(58) Field of Classification Search
CPC .... B65D 43/0235; B65D 45/32; B65D 55/02; B65D 51/1605; B65D 43/0202; B65D 45/30; B65D 2205/00; B65D 2251/205; B65D 2543/00092; B65D 2543/0024; B65D 2543/00277; B65D 2543/00537; B65D 2543/00564; B65D 79/0087
See application file for complete search history.

(56) References Cited

U.S. PATENT DOCUMENTS 2,449,014 A 9/1948 Shaffer
3,017,048 A 1/1962 Foye
3,061,130 A * 10/1962 Husum ..... B65D 41/0442 215/347
3,424,329 A * 1/1969 Hershberg ..... B65D 51/002 215/277
3,460,701 A * 8/1969 Powalowski ..... B65D 51/145 215/253
3,680,731 A * 8/1972 Lelyk ..... B65D 45/322 220/378
3,690,497 A 9/1972 Lecinski, Jr.
3,942,679 A 3/1976 Starr
4,111,330 A * 9/1978 Jordan ..... B65D 43/0216 220/270
4,122,964 A * 10/1978 Morris ..... B65D 51/145 215/276
4,159,061 A * 6/1979 Cornelius ..... B65D 45/345 215/276
4,379,455 A * 4/1983 Deaton ..... A61M 1/784 604/320
4,456,143 A * 6/1984 Davis ..... B65D 45/327 220/270
4,498,601 A * 2/1985 Fort ..... F16J 13/00 220/845
4,625,890 A * 12/1986 Galer ..... B65D 45/327 220/795
4,728,003 A * 3/1988 Davey ..... B65D 43/022 220/319
5,193,705 A * 3/1993 McCallum ..... B44D 3/127 220/798
5,261,551 A * 11/1993 Watt ..... B65D 51/18 220/798
5,785,198 A * 7/1998 Credle, Jr. ..... B65D 45/305 220/269
5,803,298 A * 9/1998 Hausmann ..... B65D 79/0087 220/322
5,875,915 A * 3/1999 Bradshaw ..... B65D 43/0218 206/508
5,964,367 A * 10/1999 Przytulla ..... B65D 11/06 220/319
6,142,330 A * 11/2000 Sacks ..... B65D 71/502 220/729
6,234,338 B1 * 5/2001 Searle ..... B65D 51/145 220/366.1
6,662,958 B2 * 12/2003 German ..... B65D 41/3423 215/276
7,040,501 B1 * 5/2006 Przytulla ..... B65D 11/06 220/659
8,342,344 B2 1/2013 Livingston
8,636,161 B2 * 1/2014 Dunwoody ..... B65D 51/145 215/276
8,991,632 B2 * 3/2015 Minnette ..... B65D 81/3453 220/359.3
9,051,088 B2 * 6/2015 Chisholm ..... B65D 51/145
9,469,445 B2 * 10/2016 Minnette ..... B29C 66/8491
10,633,164 B2 * 4/2020 Brozell ..... B65D 41/485
2002/0166836 A1 * 11/2002 Moretti ..... B65D 55/0872 215/252
2006/0091099 A1 * 5/2006 Klepac ..... B65D 45/305 215/276
2012/0043296 A1 * 2/2012 Morris ..... A47G 7/06 215/386
2013/0233898 A1 * 9/2013 Resnikoff ..... B65D 43/0202 222/568
2015/0013270 A1 * 1/2015 Chisholm ..... B65D 51/1683 215/262
2020/0062468 A1 * 2/2020 Deslauriers ..... A23L 3/0155

* cited by examiner

MASON CONTAINER LID

CROSS-REFERENCE TO RELATED APPLICATION

This patent application is a continuation-in-part of U.S. patent application Ser. No. 17/655,567, filed on Mar. 21, 2022, which claims priority to U.S. Provisional Patent Application Ser. No. 63/164,208, filed on Mar. 22, 2021, the entire disclosure of which is hereby incorporated herein by reference.

FIELD OF THE INVENTION

The invention relates to a lid element of a two-part container closure assembly such as is traditionally used with canning containers.

BACKGROUND OF THE INVENTION

Canning containers or other containers in need of hermetic sealing often utilize a two-part container closure including a lid element and a retainer element. The lid element typically includes an elastomeric ring about an underside thereof that is used to form the hermetic seal with a rim of a corresponding container. The retaining element may be a threaded collar that is mated with corresponding threads adjacent the rim of the container to position the peripheral portions of the lid element between the retaining element and the rim.

Canning processes include the creation of a vacuum within the container that is beneficial for forming and maintaining the hermetic seal between the lid element and the rim of the container. That is, the pressure differential present between the interior of the container and the ambient environment applies an axial pressure force to the lid element that aids in compressing the elastomeric ring. It is accordingly beneficial to monitor the status of this pressure differential to ensure that the hermetic seal is maintained and that air does not reach the contents of the container.

In response to this concern, lid elements used in canning processes include a seal status indicator formed by a domed portion of the lid element. When the proper pressure differential is present, the domed portion of the lid element will depress axially towards the interior of the container to visually indicate that the resulting seal is adequate. However, an improper or failed seal or microbial growth within the container can increase the pressure within the interior of the container to remove the pressure differential across the lid element, thereby causing the domed portion thereof to pop axially outwardly to a visually identifiable configuration, which also tends to correspond to the domed portion making an audible sound when depressed and released axially from this outward projecting configuration. As used hereinafter, this change is referred to as the lid element "popping" due to an insufficient pressure differential thereacross.

However, it has been discovered that the lid elements currently available suffer from various defects that render these lid elements as ineffective and unreliable in forming, maintaining, and monitoring such hermetic seals. Specifically, the lid elements of the prior art typically suffer from two major deficiencies. First, the lid element may be subject to buckling during the canning process due to the lid element having an insufficient stiffness. The canning process includes a step wherein a positive pressure is formed within the container due to the boiling of the contents of the container. The formation of this positive interior pressure occurs with the lid element covering the container. If the container is unable to vent properly, this positive pressure can eventually cause the seal of the lid element to fail via the deformation of the lid element at the location of any especially high stresses. Secondly, it has been discovered that the geometry of the lid elements of the prior art may lead to an inability to properly calibrate the lid element to pop when the desired pressure differential is present thereacross. For example, the current FDA guideline that such lid elements must pop to the visually identifiable position when the pressure differential across the lid element reaches a preselected value is not met by the geometry typical of the prior art lid elements. In fact, it has been discovered that many lid elements do not pop at all regardless of the corresponding pressure differential, and those that do pop tend to pop at unpredictable pressure differentials covering a wide range of values. A user thereof cannot accurately predict which containers have been negatively affected or which are subject to fail.

One solution to the lack of consistency in determining the pressure differential across such lid elements may include providing the domed portion to include a tangentially arranged arcuate perimeter feature acting as a form of spring element for improving the reactivity of the domed portion in popping when subjected to a desired pressure differential. However, it has been discovered that inclusion of such a spring-like feature does not significantly improve a stiffness of the lid element, hence such lid elements suffer from the same issues regarding buckling or other deformations when exposed to especially high pressure differentials.

Accordingly, it would be desirable to create a lid element having improved stiffness and a more reliable and better-calibrated pressure status alert feature.

SUMMARY OF THE INVENTION

Compatible and attuned with the present invention, an improved lid element for use in canning applications has been discovered.

In one embodiment of the invention, a lid assembly for use with a canning container having a rim and a retainer element having a radially extending portion includes a lid element having an annularly shaped peripheral portion configured to be axially aligned with and disposed between the rim of the canning container and the radially extending portion of the retainer element when the lid assembly is engaging the canning container and the retainer element is removably coupled to the canning container. An annularly shaped sealing element is disposed on the peripheral portion of the lid element and is configured to directly engage the rim of the canning container when the lid assembly is contacting the canning container. A plurality of projections is formed in the peripheral portion of the lid element with each of the projections forming a distally disposed surface of the peripheral portion with respect to an exterior axial direction of the lid element extending away from an interior of the canning container when the lid assembly is engaging the rim.

According to another embodiment of the present invention, a lid assembly for use with a canning container having a rim and a retainer element having a radially extending portion has a lid element including a centrally disposed domed portion, an annular channel portion disposed radially outwardly of the domed portion, and an annularly shaped peripheral portion disposed radially outwardly of the channel portion. The peripheral portion is configured to be axially aligned with and disposed between the rim of the canning container and the radially extending portion of the retainer element when the lid assembly is engaging the canning container and the retainer element is removably coupled to the canning container. An annularly shaped sealing element is disposed on the peripheral portion of the lid element and is configured to directly engage the rim of the canning container when the lid assembly is contacting the canning container. A plurality of projections is formed in the peripheral portion of the lid element with each of the projections forming a distally disposed surface of the peripheral portion with respect to an exterior axial direction of the lid element extending away from an interior of the canning container when the lid assembly is engaging the rim. Each of the projections is configured to directly engage the radially extending portion of the retainer element when the retainer element is removably coupled to the canning container, and each of a plurality of segments of the peripheral portion interposed circumferentially between adjacent ones of the projections is axially spaced apart from the radially extending portion of the retainer element when the retainer element is removably coupled to the canning container.

According to yet another embodiment of the present invention, a canning container assembly includes a canning container having a rim, a retainer element configured to be removably coupled to the canning container with the retainer element including a radially extending portion, a lid element having an annularly shaped peripheral portion configured to be axially aligned with and disposed between the rim of the canning container and the radially extending portion of the retainer element when the retainer element is removably coupled to the canning container, and an annularly shaped sealing element disposed on the peripheral portion of the lid element and configured to directly engage the rim of the canning container. A plurality of projections is formed in the peripheral portion of the lid element with each of the projections forming a distally disposed surface of the peripheral portion with respect to an exterior axial direction of the lid element extending away from an interior of the canning container and towards the radially extending portion of the retainer element when the retainer element is removably coupled to the canning container.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

Figure 1:
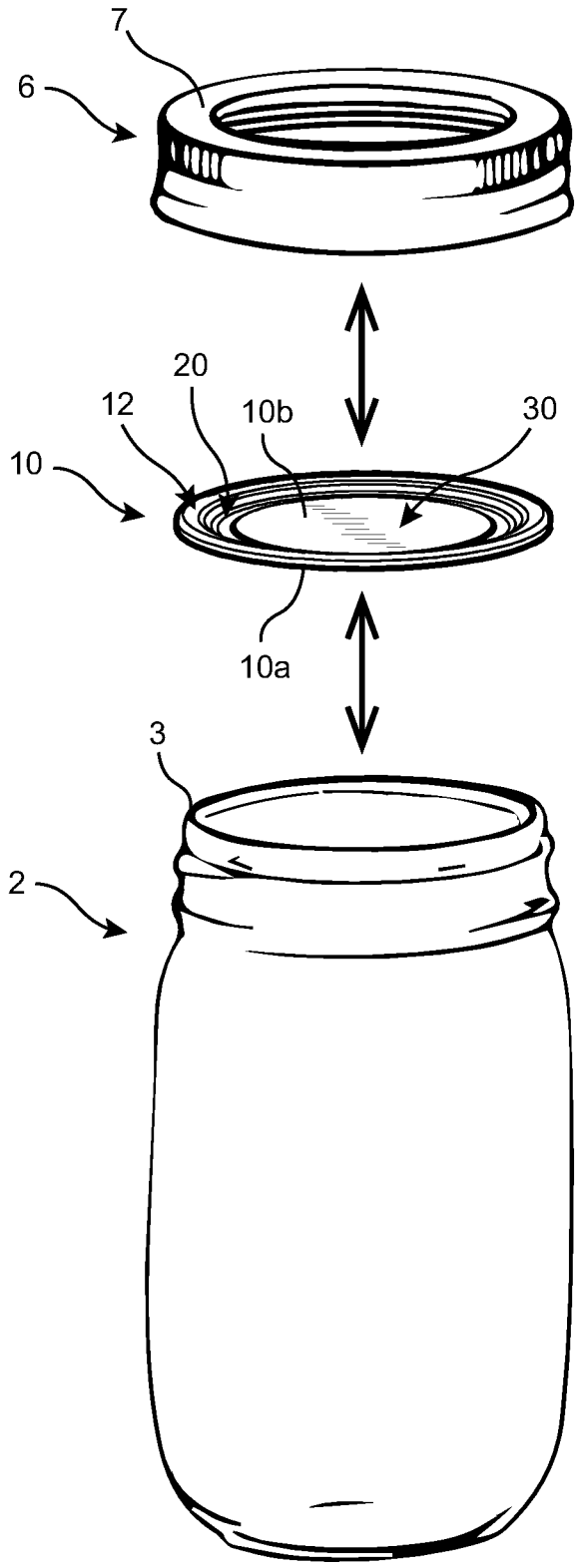
FIG. 1 is an exploded perspective view of an assembly including a canning container, a lid element according to an embodiment of the present invention, and a retainer element.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on. All values provided for the dimensions of certain features of the invention should also be understood to be subject to typical manufacturing inconsistencies and therefore may be associated with corresponding manufacturing tolerances, hence the resulting features of a manufactured article of the invention may include dimensions that vary from those listed herein in accordance with such manufacturing tolerances while remaining within the scope of the present invention.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIGS. 1-5 illustrate a lid element 10 according to an embodiment of the present invention. As shown in FIG. 1, the lid element 10 may form a component of a two-part container closure assembly in conjunction with a retainer element 6, wherein the two-part container closure assembly is configured for use with a canning container 2. The lid element 10 is configured to be disposed between a rim 3 of the canning container 2 and a radially extending portion 7 of the retainer element 6 when the retainer element 6 is engaging the canning container 2, as explained in greater detail hereinafter in describing the structure of the lid element 10.

Figure 2:
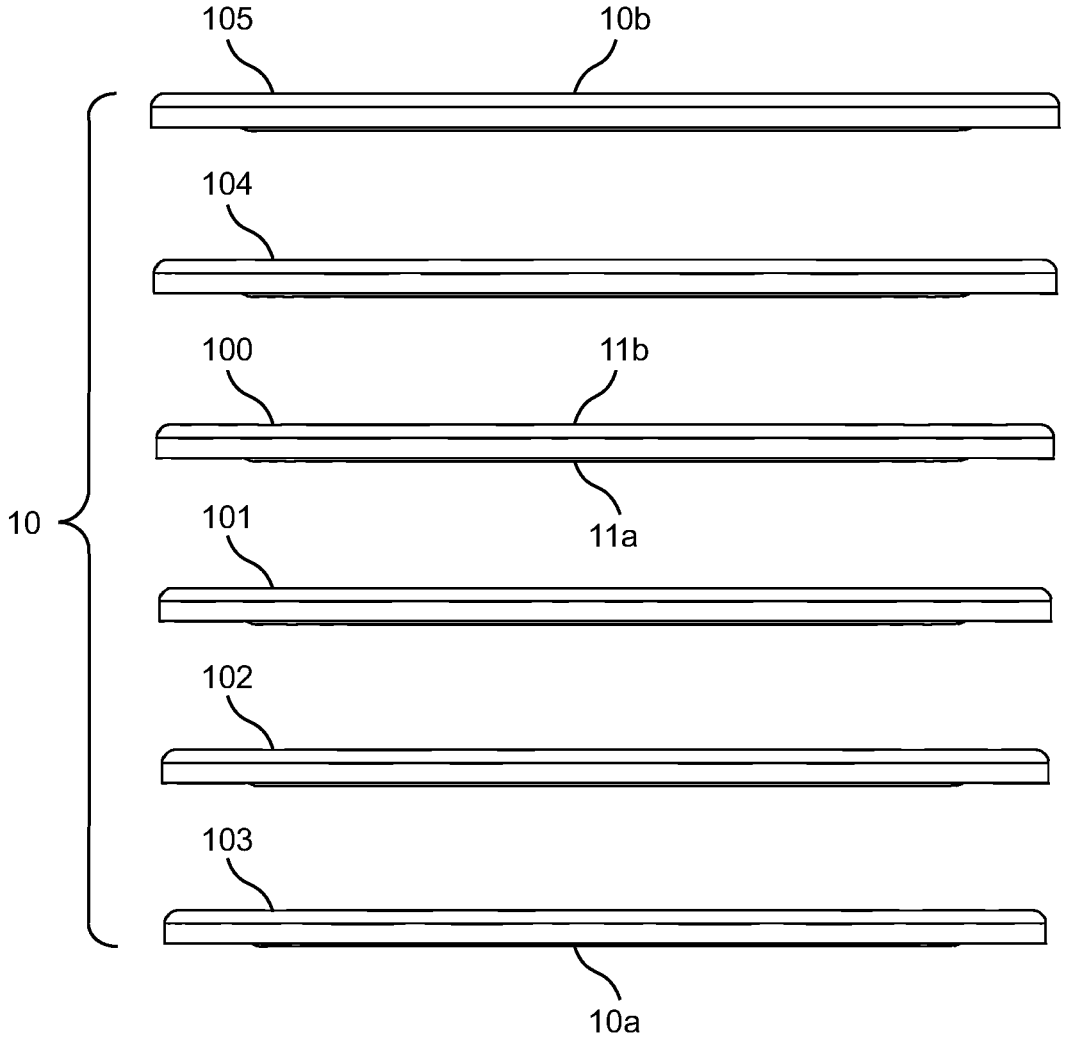
FIG. 2 is an exploded elevational side view showing the layers forming the lid element of FIG. 1.

The lid element 10 may be formed to include multiple different layers. The lid element 10 is illustrated in FIG. 2 as including six different layers (shown in exploded form), although it should be apparent to one skilled in the art that fewer or greater layers may be utilized while still appreciating the structural benefits of the disclosed lid element 10 as described herein. The number of layers and the composition of each of the corresponding layers may be selected to provide a desired strength and stiffness to the lid element 10 while also providing desired corrosion and/or contamination resistance. In the provided example, a core layer 100 may be formed from a metallic material such as steel and alloys thereof. Other suitable metallic materials may alternatively be utilized in forming the core layer 100, such as aluminum and alloys thereof, as one additional non-limiting example. The core layer 100 may also include an additional coating (not shown) of another metallic material such as tin, as desired, to one or both sides of the base metallic material of the core layer 100.

The lid element 10 further includes three inner protective layers 101, 102, 103 disposed to a side of the core layer 100 facing towards an interior of the canning container 2 when the lid element 10 is engaging the rim 3 of the canning container 2. As used hereinafter, an axial direction of the lid element 10 corresponding to the axial direction towards the interior of the canning container 2 when engaged thereto is referred to as the interior axial direction while an opposing axial direction opposite to the interior axial direction is referred to as the exterior axial direction. A first inner protective layer 101 disposed adjacent the core layer 100 towards the interior axial direction may be provided as a first corrosion protection layer and may be formed from a food grade protective layer. A second inner protective layer 102 disposed adjacent the first inner protective layer 101 towards the interior direction may be provided as a second corrosion protection layer and may be formed from a base coat of a BPA free coating. A third inner protective layer 103 disposed adjacent the second inner protective layer 102 towards the interior direction may be provided as a third corrosion protection layer and may be formed from a top coat of a BPA free coating. The BPA free coatings may be provided as coatings of polyester, as one non-limiting example.

The lid element 10 also includes two outer protective layers 104, 105 disposed to a side of the core layer 100 corresponding to an exterior of the canning container 2 when the lid element 10 is engaging the rim 3 of the canning container 2. A first outer protective layer 104 disposed adjacent the core layer 100 towards the exterior direction may be provided as a first corrosion protection layer and may be formed from a food grade protective layer. A second outer protective layer 105 disposed adjacent the first outer protective layer 104 towards the exterior direction may be provided as a second corrosion protection layer and may be formed from a BPA free coating, such as a coating of polyester. The disclosed lid element 10 accordingly includes five total corrosion protection layers in the axial direction of the canning container 2 when the lid element 10 is engaging the rim 3 thereof, with two such layers 104, 105 disposed exterior to the core layer 100 and three such layers 101, 102, 103 disposed interior to the core layer 100.

The structure of the lid element 10 is described hereinafter with reference to the configuration of the core layer 100 and the dimensions thereof, as the metallic core layer 100 is primarily responsible for the mechanical properties of the lid element 10 that are relevant during operation thereof. The core layer 100 generally includes an inner face 11*a* facing towards the interior axial direction and an outer face 11*b* facing towards the exterior axial direction. A thickness of the core layer 100 of the lid element 10 accordingly corresponds to a distance present between the inner face 11*a* and the outer face 11*b* in a direction substantially perpendicular to each of the faces 11*a*, 11*b* with respect to the location at which such thickness is determined. It should generally be understood that any references hereinafter to a surface feature of the inner face 11*a* or the outer face 11*b* having a first radius of curvature may also correspond to the other of the inner face 11*a* or the outer face 11*b* having a corresponding second radius of curvature offset from the first radius of curvature by a distance substantially corresponding to that of the nominal thickness of the core layer 100, assuming a substantially constant thickness of the core layer 100 across such features. However, a thickness of the core layer 100 may vary with respect to different features thereof, as desired, without necessarily departing from the scope of the present invention. As shown in FIG. 5, the core layer 100 of the lid element 10 of FIGS. 1-5 may include a nominal thickness T of about 0.0063-0.0070 inches, as one non-limiting range of possible values.

The core layer 100 may be formed into the configuration shown throughout FIGS. 1-5 during a manufacturing process such as a suitable stamping process. The additional layers 101, 102, 103, 104, 105 described above may then be coated, plated, or otherwise applied to the opposing faces 11*a*, 11*b* of the core layer 100 using any method, and may be applied to have any desired thickness, following the deformation of the core layer 100 to the disclosed configuration. In other embodiments, at least one of the layers or coatings may be added to the core layer 100 prior to the deformation into the configuration disclosed herein. In any event, the resulting lid element 10 includes the core layer 100 and each of the coatings 101, 102, 103, 104, 105 present thereon having the same general configuration, with any dimensions of the coatings 101, 102, 103, 104, 105 substantially offset from those described hereinafter with respect to the core layer 100 in accordance with the thickness of each respective layer. For example, a layer added to either face 11*a*, 11*b* of the core layer 100 should be expected to include a radius of curvature on an outer surface thereof that is offset from the radius of curvature of the corresponding face 11*a*, 11*b* of the core layer 100 by the thickness of the added layer, assuming a substantially consistent thickness of the additional layer.

The lid element 10 is described hereinafter as including an inner face 10*a* and an opposing outer face 10*b* in similar fashion to the faces 11*a*, 11*b* of the core layer 100. The inner face 10*a* refers to the exposed surface of the lid element 10 facing in the interior axial direction as provided by an outermost of the layers added to the inner face 11*a* of the core layer 100 while the outer face 10*b* refers to the exposed surface of the lid element 10 facing in the exterior axial direction as provided by an outermost of the layers added to the outer face 11*b*. One or both of the faces 11*a*, 11*b* of the core layer 100 may also correspond to one or both of the faces 10*a*, 10*b* of the lid element 10, depending on whether any protective layers have been added thereto.

Figure 3:
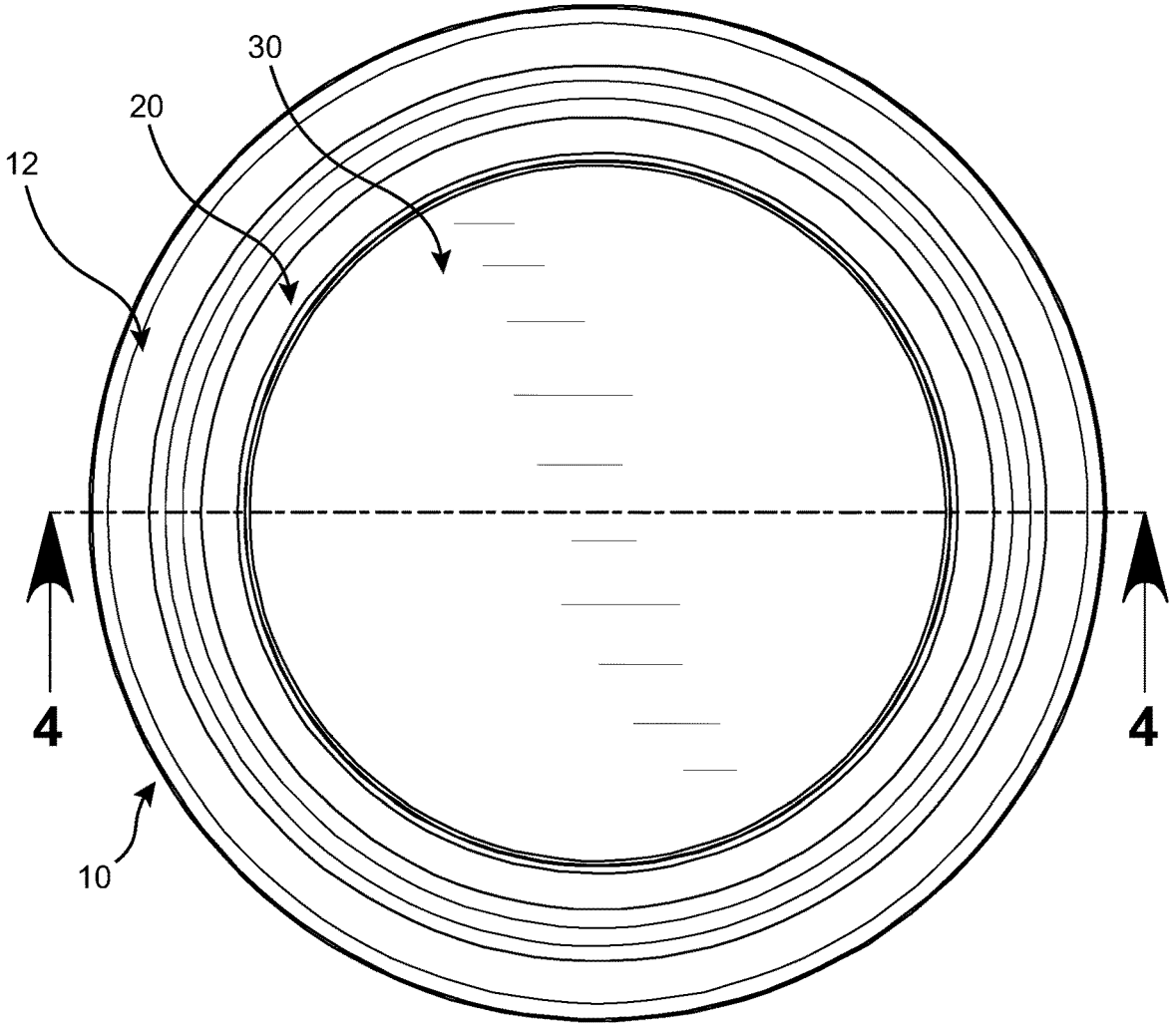
FIG. 3 is a top plan view of a lid element according to the present invention that is suitable for use with a regular mouth canning container.
Figure 4:
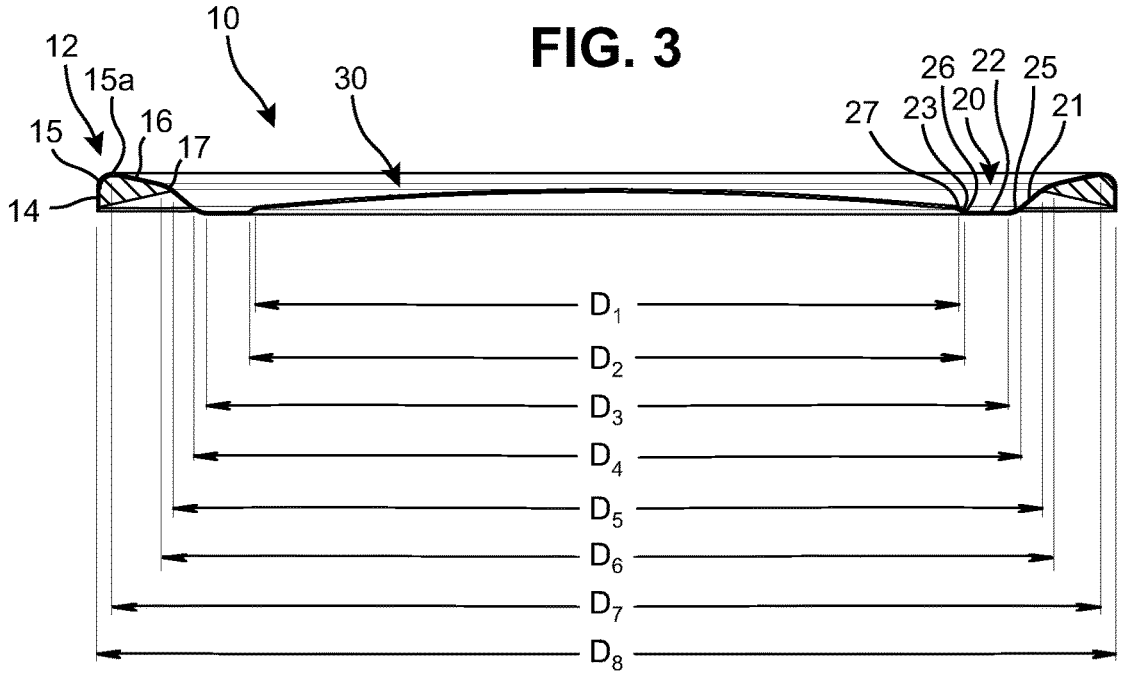
FIG. 4 is a cross-sectional view of the lid element of FIG. 3 as taken from the perspective of section lines 4-4.
Figure 5:
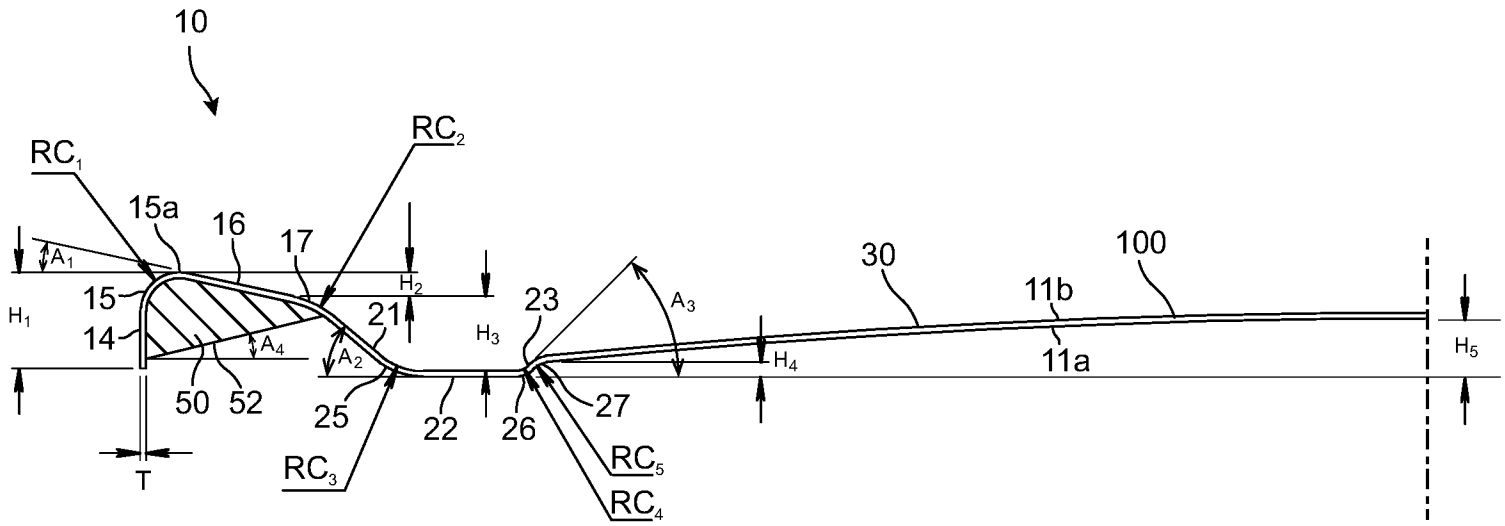
FIG. 5 is an enlarged fragmentary cross-sectional view of the lid element of FIG. 3.
Figure 6:
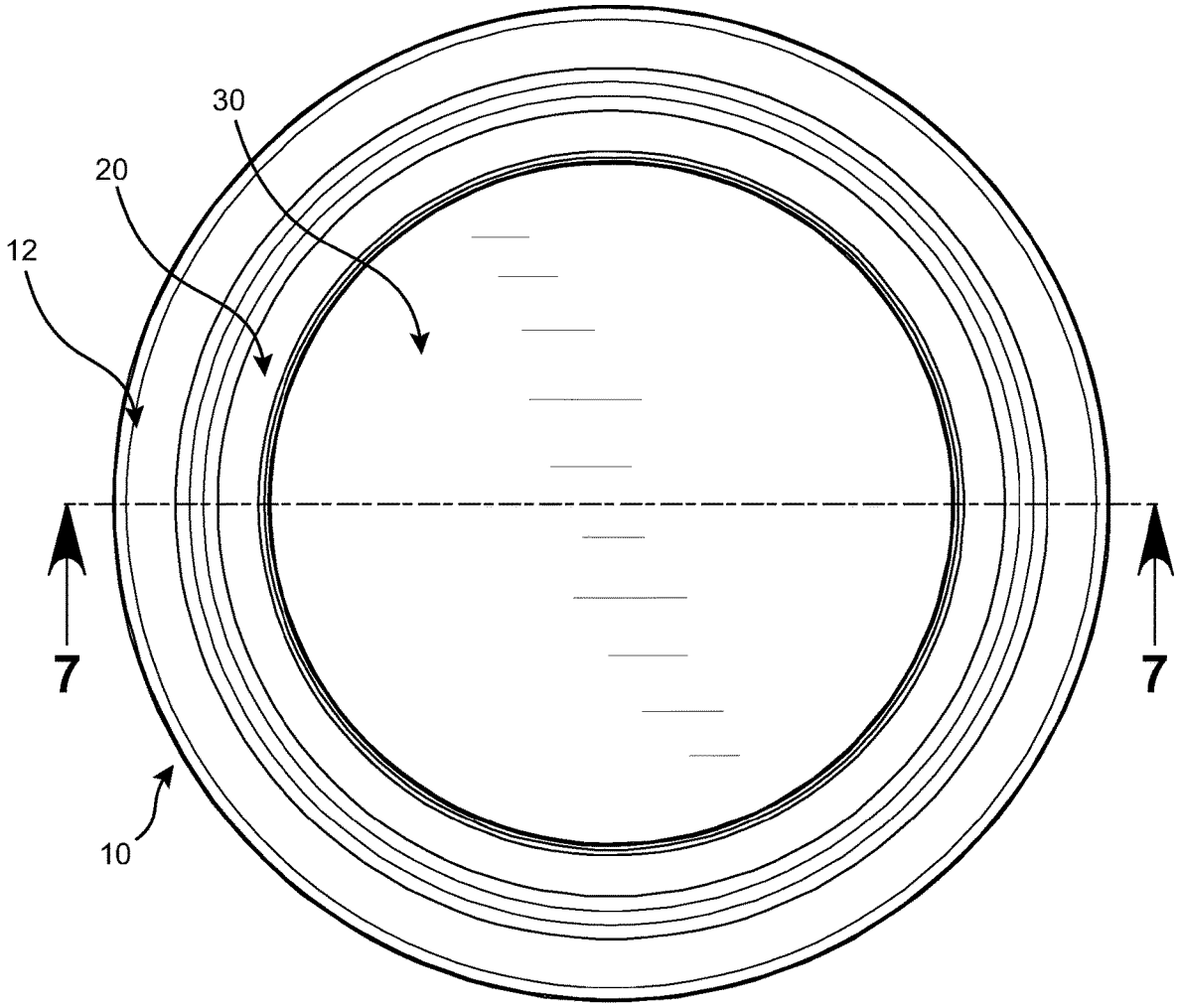
FIG. 6 is a top plan view of a lid element according to the present invention that is suitable for use with a wide mouth canning container.
Figure 7:
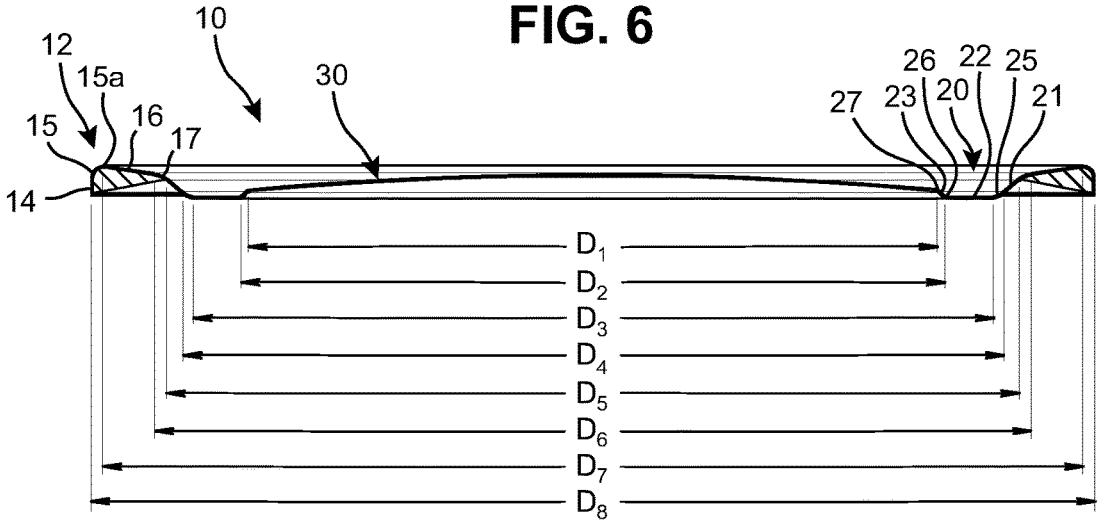
FIG. 7 is a cross-sectional view of the lid element of FIG. 6 as taken from the perspective of section lines 7-7.

As best shown in FIGS. 3-5, the lid element 10 (and hence the core layer 100 establishing the structural configuration of the lid element 10) generally includes a peripheral portion 12, a channel portion 20, and a domed portion 30. The domed portion 30 forms a central portion of the lid element 10 and includes a circular perimeter shape. The channel portion 20 is disposed radially outwardly of the domed portion 30 and the peripheral portion 12 is disposed radially outwardly of the channel portion 20. The peripheral portion 12 and the channel portion 20 are each annular in shape. As such, it should be apparent that the lid element 10 is substantially axially symmetric about a central axis thereof and each of the features described hereinafter with reference to the cross-sectional views of the lid element 10 shown in FIGS. 4 and 5 should be understood to extend circumferentially around a full 360 degrees relative to the central axis.

The peripheral portion 12 includes an annularly extending skirt segment 14 arranged to extend in parallel to an axial direction of the lid element 10, which also corresponds to the axial direction of the canning container 2 when the lid element 10 is engaged thereto. The skirt segment 14 is substantially cylindrical in shape and is configured to extend around an outer circumferential surface of the rim 3 of the canning container 2. The skirt segment 14 also forms an outer circumferential surface of the lid element 10 having a maximum radial distance from a central axis of the lid element 10. The peripheral portion 12 is configured to be axially aligned with the rim 3 of the canning container 2 about an entirety of a circumference thereof at a position radially inward of the skirt segment 14 thereof when the lid element 10 is properly engaging the rim 3.

An arcuate transition segment 15 extends arcuately through at least 90 degrees of curvature and connects the skirt segment 14 to an engaging segment 16 of the peripheral portion 12 disposed radially inwardly of the skirt segment 14. More specifically, the arcuate transition segment 15 is initially arranged parallel to the axial direction where the arcuate transition segment 15 first extends tangentially away from the skirt segment 14 and curves radially inwardly along a circular curvature until transitioning to the annular engaging segment 16.

The engaging segment 16 may be arranged at an angle $A_1$ with respect to a radial direction of the lid element 10, which is arranged perpendicular to the axial direction thereof. The angle $A_1$ is shown in FIG. 5 as being about 12-14°, but other angles of inclination may be utilized without necessarily departing from the scope of the present invention. In some embodiments, the angle $A_1$ may be between 0° (corresponding to a radially extending segment) and 20°. In other embodiments, the angle $A_1$ may be between 9° and 15°. The inclination of the engaging segment 16 and annular extension thereof results in the engaging segment 16 having a frustoconical shape. The inclination of the engaging segment 16 is shown as including the engaging segment 16 extending partially in the interior axial direction when progressing in the radial inward direction of the lid element 10 away from the arcuate transition segment 15 and towards the channel portion 20 of the lid element 10. It should also be apparent that the angle of curvature through which the arcuate transition segment 15 extends is accordingly determined by the angle $A_1$, which is added to the previously disclosed 90° to determine the total angle of curvature of the arcuate transition segment 15. In the present embodiment, the angle $A_1$ of 12-14° therefore corresponds to the arcuate transition segment 15 extending through an angle of about 102°-104° of curvature.

The arcuate transition segment 15 forms a convex surface along the outer face 11*b* of the core layer 100 and a concave surface along the inner face 11*a* thereof. As shown in FIG. 5, the arcuate transition segment 15 may include a radius of curvature $RC_1$ of about 0.040 inches along the convex surface of the outer face 11*b*, as one non-limiting example. However, other values may be selected for $RC_1$ without necessarily departing from the scope of the present invention. For example, in other embodiments, the radius of curvature $RC_1$ may be between 0.030 and 0.050 inches, as desired.

The outer face 10*b* of the lid element 10 is configured to eventually engage an inner facing surface of the radially extending portion 7 of the retainer element 6 along at least one of the arcuate transition segment 15 and/or the engaging segment 16 when the retainer element 6 is progressively threaded relative to the canning container 2 with the lid element 10 engaging the rim 3 thereof. As shown in FIG. 5, an annular apex surface 15*a* formed along a portion of the arcuate transition segment 15 disposed distally from a plane defined by an end of the skirt 14 with respect to the axial direction and also arranged parallel to such a plane (providing a radially extending surface) may be configured to provide an annular surface along which the radially extending portion 7 of the retainer element 6 first contacts the peripheral portion 12 of the lid element 10 when progressing axially theretowards during a threading of the retainer element 6 relative to the canning container 2.

The channel portion 20 includes an outer angled segment 21, a planar segment 22, and an inner angled segment 23. A radial inward end of the peripheral portion 12 includes an arcuate transition segment 17 arcuately connecting the engaging segment 16 to the outer angled segment 21 of the channel portion 20. The arcuate transition segment 17 includes a circular curvature and curves through an angle corresponding to a difference in inclination present between the engaging segment 16 of the outer angled segment 21. As shown in FIG. 5, the transition segment 17 forms a concave surface along the inner face 11*a* and a convex surface along the outer face 11*b* when connecting the engaging segment 16 to the outer angled segment 21. A radius of curvature $RC_2$ of the convex surface formed by the arcuate transition segment 17 along the outer face 11*b* may be about 0.100 inches, as one non-limiting example. However, other values may be selected for the radius of curvature $RC_2$ without necessarily departing from the scope of the present invention. For example, in other embodiments, the radius of curvature $RC_2$ may be between 0.090 and 0.110 inches, as desired.

The outer angled segment 21 is inclined to extend partially in the radially inward direction and partially in the interior axial direction as the outer angled segment 21 extends away from the arcuate transition segment 17 and towards an outer channel transition segment 25 connecting the outer angled segment 21 to the planar segment 22 of the channel portion 20. The inclination of the outer angled segment 21 results in the outer angled segment 21 having a frustoconical shape. The outer angled segment 21 may be inclined by an angle $A_2$ relative to the radial direction of the lid element 10, which is illustrated in FIG. 5 as being about 40°. However, other values may be selected for the angle $A_2$ while remaining within the scope of the present invention. In some embodiments, the angle $A_2$ is selected to be between 35° and 45°. In other embodiments, the angle $A_2$ is selected to be between 30° and 50°.

The outer channel transition segment 25 arcuately connects the outer angled segment 21 to the planar segment 22 of the channel portion 20. The outer channel transition segment 25 includes a circular curvature and curves through an angle corresponding to a difference in inclination present between the outer angled segment 21 and the planar segment 22, which corresponds to the angle $A_2$. As shown in FIG. 5, the outer channel transition segment 25 forms a convex surface along the inner face 11*a* and a concave surface along the outer face 11*b* when connecting the outer angled segment 21 to the planar segment 22. A radius of curvature $RC_3$ of the concave surface formed by the outer channel transition segment 25 along the outer face 11*b* may be about 0.070 inches, as one non-limiting example. However, other values may be selected for the radius of curvature $RC_3$ without necessarily departing from the scope of the present invention. For example, the radius of curvature $RC_3$ may be between 0.060 and 0.080 inches, as desired.

The planar segment 22 is arranged in the radial direction of the lid element 10. The planar segment 22 extends radially inwardly from the outer channel transition segment 25 to an inner channel transition segment 26 connecting the planar segment 22 to the inner angled segment 23. The inner angled segment 23 is inclined to extend partially in the radially inward direction and partially in the exterior axial direction as the inner angled segment 23 extends away from the inner channel transition segment 26 and towards the centrally disposed domed portion 30 of the lid element 10. The inner angled segment 23 accordingly includes a slope that is opposed to that of the outer angled segment 21. The inclination of the inner angled segment 23 and the annular configuration thereof results in the inner angled segment 23 having a frustoconical shape. The inner angled segment 23 may be inclined by an angle $A_3$ relative to the radial direction of the lid element 10, which is illustrated in FIG. 5 as being about 45°. However, other values may be selected for the angle $A_3$ while remaining within the scope of the present invention. In some embodiments, the angle $A_3$ is selected to be between 40° and 50°. In other embodiments, the angle $A_3$ is selected to be between 35° and 55°.

The inner channel transition segment 26 arcuately connects the planar segment 22 to the inner angled segment 23. The inner channel transition segment 26 includes a circular curvature and curves through an angle corresponding to a difference in inclination present between the inner angled segment 23 and the planar segment 22, which corresponds to the angle $A_3$. As shown in FIG. 5, the inner channel transition segment 26 forms a convex surface along the inner face 11*a* and a concave surface along the outer face 11*b* when connecting the inner angled segment 23 to the planar segment 22. A radius of curvature $RC_4$ of the concave surface formed by the inner channel transition segment 26 along the outer face 11*b* may be about 0.020 inches, as one non-limiting example. However, other values may be selected for the radius of curvature $RC_4$ without necessarily departing from the scope of the present invention. For example, the radius of curvature $RC_4$ may be between 0.010 and 0.030 inches, as desired.

A dome transition segment 27 arcuately connects the inner angled segment 23 to the domed portion 30 of the lid element 10. The dome transition segment 27 includes a circular curvature and curves through an angle corresponding to a difference in inclination present between the inner angled segment 23 and a periphery of the domed portion 30. As shown in FIG. 5, the inner channel transition segment 26 forms a concave surface along the inner face 11*a* and a convex surface along the outer face 11*b* when connecting the inner angled segment 23 to the domed portion 30. A radius of curvature $RC_5$ of the concave surface formed by the dome transition segment 27 along the inner face 11*a* may be about 0.020 inches, as one non-limiting example. However, other values may be selected for the radius of curvature $RC_5$ without necessarily departing from the scope of the present invention. For example, the radius of curvature RC5 may be between 0.010 and 0.030 inches, as desired.

The domed portion 30 is initially angled relative to the radial direction of the lid element 10 adjacent the inner angled segment 23 and the dome transition segment 27 before curving to be arranged parallel to the radial direction at the central axis of the domed portion 30. The angle of inclination of the domed portion 30 adjacent the inner angled segment 23 is selected to be less than that of the inner angled segment 23 relative to the radial direction, and may generally be within a range of about 3-5°. The domed portion 30 may include a circular curvature having a radius of curvature far exceeding that of the previously disclosed radii of curvature $RC_1$, $RC_2$, $RC_3$, $RC_4$, $RC_5$. The domed portion 30 extends a distance in the radial direction of the lid element 10 that is greater than a distance the channel portion 20 extends in the radial direction of the lid element 10 or a distance the peripheral portion 12 extends in the radial direction of the lid element 10. The distance the domed portion 30 extends in the radial direction is also greater than a combined distance the peripheral portion 12 and the channel portion 20 extend in the radial direction.

The lid element 10 further includes a sealing element 50 disposed along the inner face 10*a* thereof at the peripheral portion 12 thereof. Specifically, the sealing element 50 is disposed to contact at least a portion of each of the skirt segment 14, the arcuate transition segment 15, the engaging segment 16, and the arcuate transition segment 17 of the lid element 10. A radially outward end of the sealing element 50 may be disposed immediately adjacent an axial end of the skirt segment 14 while a radially inward end of the sealing element 50 may contact the arcuate transition segment 17. As shown in FIG. 5, an engaging surface 52 of the sealing element 50 connecting the radially inward and outward ends of the sealing element 50 may be disposed to be inclined at an angle $A_4$ relative to the radial direction. The inclination of the engaging surface 52 may include the engaging surface 52 progressing at least partially in the exterior axial direction and at least partially in the radial inward direction when extending from the radially outward end to the radially inward end thereof. In the present embodiment, the angle $A_4$ is about 12-14°. However, alternative values may be selected for the angle $A_4$ without necessarily departing from the scope of the present invention. In some embodiments, the angle $A_4$ may be selected to be between 0° and 20°. In other embodiments, the angle $A_4$ may be selected to be between 10° and 15°. The inclination of the engaging surface 52 and the annular configuration thereof results in the engaging surface 52 being frustoconical in shape.

The sealing element 50 may be formed from a flexible and resilient elastomeric material such as a suitable rubber. The sealing element 50 is configured to engage an axial end portion of the rim 3 of the canning container 2 during a canning process. The sealing element 50 may be further configured to sealingly engage the rim 3 when a pressure differential is formed between the interior and the exterior of the canning container 2 with respect to the opposing faces 10*a*, 10*b* of the lid element 10 such that the lid element 10 is urged in the interior axial direction and the sealing element 50 is compressed in the axial direction between the peripheral portion 12 and the rim 3. The engaging surface 52 may be selected to include the described inclination to aid in centering the lid element 10 relative to the rim 3. Additionally, the described inclination of the engaging surface 52 also results in a reaction force present between the sealing element 50 and the rim 3 extending at least partially in the radial direction of each of the canning container 2 and the lid element 10, which aids in ensuring a suitable seal around an entirety of the perimeter of the rim 3 when a suitable pressure differential is present.

The lid element 10 shown throughout FIGS. 1-5 may correspond to an embodiment of the lid element 10 configured for use with a canning container 2 having a rim 3 of a specified radius/diameter suitable for sealingly engaging the corresponding sealing element 50. The sealing element 50 may accordingly extend along those radial positions corresponding to a nominal radius of the rim 3 of the canning container 2 to ensure contact therebetween when the lid element 10 is centered relative to the rim 3. The illustrated canning container 2 of FIG. 1 may be representative of a "regular mouth" canning container having a rim 3 with a diameter of about 2.5 inches, hence the lid element 10 of FIGS. 1-5 may be dimensioned for use with such a regular mouth canning container. Specifically, as illustrated in FIG. 3, a series of diameters of the lid element 10 at the positions of various features described hereinabove are given with respect to the embodiment of the lid element 10 suitable for use with the regular mouth canning container having the 2.5 inch diameter rim 3.

The disclosed diameters include a diameter $D_1$ corresponding to an outer diameter of the domed portion 30 and an inner diameter of the inner angled segment 23. A diameter $D_2$ corresponds to an outer diameter of the inner angled segment 23 and an inner diameter of the planar segment 22. A diameter $D_3$ corresponds to an outer diameter of the planar segment 22 and an inner diameter of the outer transition segment 25. A diameter $D_4$ corresponds to an outer diameter of the outer transition segment 25 and an inner diameter of the outer angled segment 21. A diameter $D_5$ corresponds to an inner diameter of the arcuate transition segment 17 and an outer diameter of the outer angled segment 21. A diameter $D_6$ corresponds to an inner diameter of the outer angled segment 21 and an inner diameter of the engaging segment 16. A diameter $D_7$ corresponds to a diameter of the annular apex surface 15*a* formed at the apex of the arcuate transition segment 15. Finally, a diameter $D_8$ corresponds to an outer diameter of the skirt segment 14.

In the example shown in FIGS. 1-5, the value for $D_1$ is about 1.850 inches, the value for $D_2$ is about 1.880 inches, the value for $D_3$ is about 2.104 inches, the value for $D_4$ is about 2.182 inches, the value for $D_5$ is about 2.278 inches, the value for $D_6$ is about 2.364 inches, the value for $D_7$ is about 2.602 inches, and the value for $D_8$ is about 2.682 inches. Although not pictured in FIG. 4, a radially inner end of the sealing element 50 may be positioned intermediate the positions corresponding to the diameters $D_5$ and $D_6$. In the present embodiment, the radially inner end of the sealing element 50 includes a diameter of 2.300 inches. A radial distance of each identified position from the central axis of the lid element 10 is of course understood to be equal to half of each of the provided diameter values.

Additionally, various axial distances associated with the lid element 10 suitable for use with the regular mouth canning container are also shown in FIG. 5, wherein each of the axial distances is referred to as a height of each of the corresponding features. A first height $H_1$ corresponds to the axial distance present between a distal end of the skirt segment 14 and the annular apex surface 15*a*, and may accordingly correspond to a height of the peripheral portion 12. A second height $H_2$ corresponds to the axial distance present between the annular apex surface 15*a* and a junction of the radially inward end of the engaging segment 16 and the radially outward end of the arcuate transition segment 17. A third height $H_3$ corresponds to the axial distance present between the junction of the radially inward end of the engaging segment 16 and the radially outward end of the arcuate transition segment 17 and the outer face 11*b* along the planar portion 22 of the channel portion 20, which also corresponds to a height of the outer angled segment 21 when including the adjacent transition segments 17, 25. A fourth height $H_4$ corresponds to an axial height of the inner angled segment 23. A fifth height $H_5$ corresponds to an axial distance between the domed portion 30 at a central axis of the lid element 10 as measured from the inner face 11*a* of the planar segment 22 of the channel portion 20. In the example shown in FIGS. 1-5, the value for $H_1$ is about 0.100 inches, the value for $H_2$ is about 0.025 inches, the value for $H_3$ is about 0.078 inches, the value for $H_4$ is about 0.016 inches, and the value for $H_5$ is about 0.061 inches. A height of the domed portion 30 itself, which corresponds to the distance the domed portion 30 extends axially in the exterior axial direction beyond the inner angled segment 23, is equal to a difference between $H_5$ and $H_4$, which is 0.045 inches in the present example.

Based on the disclosed dimensions, the lid element 10 includes the domed portion 30 extending radially relative to the central axis of the lid element 10 a distance of about 0.925 inches, the channel portion 20 (corresponding to the portions of the lid element 10 extending radially between the positions of the identified diameters $D_1$ and $D_6$) extending radially about 0.257 inches, and the peripheral portion 12 (corresponding to the portions of the lid element 10 disposed radially outwardly of the position of the identified diameter $D_6$) extending radially about 0.159 inches. As such, the domed portion 30 occupies about 69% of the radial extension of the lid element 10, the channel portion 20 occupies about 19% of the radial extension thereof, and the peripheral portion 12 occupies about 12% of the radial extension thereof. The planar segment 22 of the channel portion 20 extends radially about 0.112 inches, which occupies about 44% of the radial extension of the channel portion 20 and about 8% of the radial extension of the lid element 10. The lid element 10 also includes the domed portion 30 having a height greater than that of the inner angled segment 23 with respect to the axial direction.

In contrast to FIGS. 1-5, FIGS. 6 and 7 illustrate the lid element 110 as being dimensioned for use with a canning container 2 representative of a "wide mouth" canning container having a rim 3 with a diameter of about 3.25 inches. As can be seen by comparison of FIGS. 4 and 7, the lid element 110 is substantially similar to the lid element 10 and includes the same general configuration (hence same reference numerals refer to the same features), but is dimensioned alternatively to maintain the same structural benefits of the lid element 10 while accommodating the increased diameter of the rim 3. Despite the differences in diameter, the lid element 110 shares many of the same characteristics as the lid element 10. Specifically, the lid element 110 may maintain the same values for each of the thickness T, the angle $A_2$, the angle $A_3$, the angle $A_4$, the radius of curvature $RC_1$, the radius of curvature $RC_2$, the radius of curvature $RC_3$, the radius of curvature $RC_4$, the height $H_1$, the height $H_2$, and the height $H_3$. The lid element 110 may differ from the lid element 10 by including an angle $A_1$ of about 8-9° (rather than 12-14°), a radius of curvature $RC_5$ of 0.010 inches (rather than 0.020), a height $H_4$ of 0.025 inches (rather than 0.016), and a height $H_5$ of 0.075 inches (rather than 0.061). A height of the domed portion 30 itself, which corresponds to a difference between $H_5$ and $H_4$, is also 0.050 inches in the present example (rather than 0.045).

The lid element 110 also includes different values of the disclosed diameters in accordance with the enlarged diameter of the rim 3 of the wide mouth canning container 2. Specifically, in the example shown in FIGS. 6 and 7, the value for $D_1$ is about 2.281 inches, the value for $D_2$ is about 2.330 inches, the value for $D_3$ is about 2.638 inches, the value for $D_4$ is about 2.713 inches, the value for $D_5$ is about 2.806 inches, the value for $D_6$ is about 2.906 inches, the value for $D_7$ is about 3.242 inches, and the value for $D_8$ is about 3.322 inches. Although not pictured in FIG. 7, a radial inner end of the sealing element 50 may be positioned intermediate the positions corresponding to the diameters $D_5$ and $D_6$. In the present embodiment, the radial inner end of the sealing element 50 includes a diameter of 2.849 inches. A radial distance of each identified position from the central axis of the lid element 110 is of course understood to be equal to half of each of the provided diameter values.

Based on the disclosed dimensions, the lid element 110 includes the domed portion 30 extending radially relative to the central axis of the lid element 110 a distance of about 1.141 inches, the channel portion 20 (corresponding to the portions of the lid element 10 extending radially between the positions of the identified diameters $D_1$ and $D_6$) extending radially about 0.312 inches, and the peripheral portion 12 (corresponding to the portions of the lid element 10 disposed radially outwardly of the position of the identified diameter $D_6$) extending radially about 0.208 inches. As such, the domed portion 30 occupies about 69% of the radial extension of the lid element 110, the channel portion 20 occupies about 19% of the radial extension thereof, and the peripheral portion 12 occupies about 12% of the radial extension thereof. The planar segment 22 of the channel portion 20 extends radially about 0.154 inches, which occupies about 49% of the radial extension of the channel portion 20 and about 9% of the radial extension of the lid element 110. The lid element 110 also includes the domed portion 30 having a height greater than that of the inner angled segment 23 with respect to the axial direction.

Despite the differences in diameters, it should be apparent that each of the lid elements 10, 110 includes substantially similar proportions of the radial extensions of each of the disclosed features in conjunction with utilizing the same angles of inclination for each of the opposing angled segments 21, 23 straddling the planar segment 22. This similarity in structure results in each of the lid elements 10, 110 operating in substantially the same manner as described hereinafter.

It has been discovered that the channel portion 20 of each of the disclosed lid elements 10, 110, which is considered to be inclusive of the adjacent transition segments 17 and 27 at the radially outer and inner ends of the channel portion 20, respectively, forms a stiffening feature of the present invention that significantly reduces the stresses encountered within the corresponding lid element 10, 110 when subjected to typical pressures as experienced during and after a canning process. For example, as mentioned hereinabove, the canning process includes a positive pressure forming within the interior of the canning container 2 due to the heating of the fluids contained therein, wherein this positive pressure can apply a force to the corresponding lid element 10, 110 in the exterior axial direction against the retainer element 6 (when coupled to the canning container 2). This force can continue to increase if the gases disposed within the canning container 2 are unable to vent properly around the periphery of the corresponding lid element 10, 110. Additionally, following the canning process, a partial vacuum is generated within the canning container 2 such that the pressure applied to the lid element 10, 110 is in the interior axial direction. In either circumstance, the lid elements 10, 110 as disclosed herein are much less likely to fail from pressure induced buckling or other stress induced deformations due to the increased stiffness thereof in comparison to the lid elements of the prior art.

Specifically, the novel structure of the channel portion 20 forms a rib-like strengthening structure by extending portions of the corresponding lid element 10, 110 axially beyond the adjacent portions of the lid element 10, 110 to increase an area moment of inertia of the lid element 10, 110 about the expected bending planes thereof. As can be seen in either of FIG. 4 or 7, the planar segment 22 of the channel portion 20 is disposed on a plane that is disposed axially beyond a plane defined by the distal end of the skirt segment 14 with respect to the interior axial direction. In other words, the channel portion 20 extends further in the interior axial direction than does the skirt segment 14 of the peripheral portion 12, which results in at least a portion of the channel portion 20 extending axially beyond an expected bending plane of the lid element 10, 110. This redistributes the mass of the lid element 10, 110 at a distance to each of the opposing sides of the expected bending plane, which renders the lid element 10, 110 as more stiff when attempting to bend the lid element 10, 110 away from such a plane, as may occur when the lid element 10, 110 attempts to buckle under pressure.

Additionally, it has also been discovered that the specific configuration of the inner angled segment 23 and each of the adjoining transition segment 26, 27 not only aids in forming a stiffening feature, but facilitates the ability to calibrate a preselected value or range of values of the pressure differential formed between the opposing faces 10*a*, 10*b* of the corresponding lid element 10, 110 at which the domed portion 30 will be inverted in concavity and audibly and visually pop. The domed portion 30 can also be calibrated to experience a maximum inversion of the concavity of the domed portion 30 at a preselected value or range of values of the pressure differential. For example, the domed portion 30 can be calibrated to pop when subjected to a range of pressure differentials of about 1.7-2.5 psi, and may be further calibrated to reach a maximum inversion at a pressure differential of 5.0 psi. In other embodiments, the domed portion 30 may be calibrated to pop when exposed to a pressure differential of 3.0 psi. The calibration of the domed portion 30 is possible because of the specific relationship present at the transition from the planar segment 22 to the inner angled segment 23 as well as the transition from the inner angled segment 23 to the domed portion 30 as offered by the transition segments 26, 27 having the disclosed concavities and curvatures. It has been discovered that the disclosed configuration provides a pop indicating feature that renders it more predictable at what pressure differential the domed portion 30 will invert from having the convex outer face 10*b* to having a concave outer face 10*b*.

It has been discovered that the geometry of the disclosed lid elements 10, 110 leads to the lid elements 10, 110 experiencing a decreased maximum stress, regardless of whether the corresponding lid element 10, 110 is subjected to an interior or exterior directed axial force. This decreased maximum stress results in the present invention having an increased factor of safety in comparison to the lid geometries of the prior art with respect to both respective pressure conditions. The stiffening and strengthening features of the present invention accordingly result in the lid elements 10, 110 having improved resistance to buckling or other forms of deformation regardless of the direction of the axial pressure forces acting on the lid elements 10, 110. The lid elements 10, 110 can accordingly be used reliably, both during the canning process and after the canning process, in comparison to the lid elements of the prior art.

The improved strength of the lid elements 10, 110 may also facilitate the formation of the lid elements 10, 110 using materials different from those normally utilized in the formation of the lid elements of the prior art or may facilitate the ability to form the lid elements 10, 110 with a decreased material thickness, as desired. For example, aluminium or an alloy thereof may be used as the base material in forming the core layer 100 in order to reduce the cost to manufacture the lid elements 10, 110. The use of aluminium in forming the lid elements 10, 110 also advantageously facilitates the ability to render the lid elements 10, 110 as recyclable. The prevalence of canning containers and associated lid elements renders the ability to recycle the lid elements 10, 110 of the present invention as a significant environmental advantage in comparison to the lid elements of the prior art.

Additionally, the improved sealing conditions and reliability of the seal status indicator feature also provide beneficial health conditions as noxious odors cannot escape the corresponding containers. The improved seal also reduces the risk of food borne illness as a result of microbial infestation of the foods contained within the container.

The lid elements 10, 110 of the present invention also pop at a substantially consistent pressure differential value, thereby improving the reliability of the lid elements 10, 110 in comparison to the prior art. The features described herein relating to the transition from the channel portion 20 to the domed portion 30 accordingly aid in calibrating the popping of the lid element 10 to a desired pressure differential value.

Figure 8:
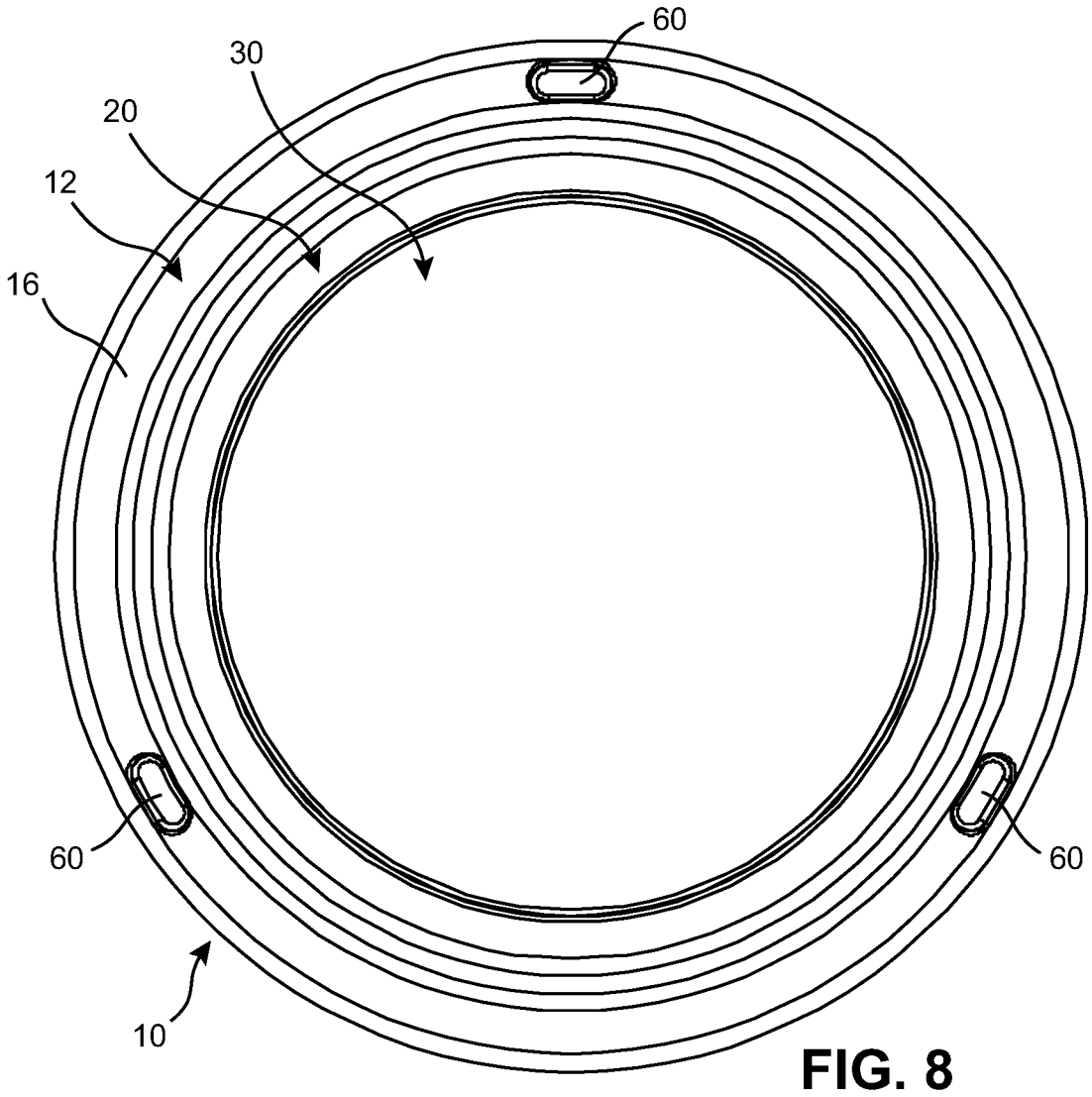
FIG. 8 is a top plan view of a lid element having a torque-limiting feature in the form of an annular array of projections and corresponding indentations formed in a peripheral portion of the lid element.
Figure 9:
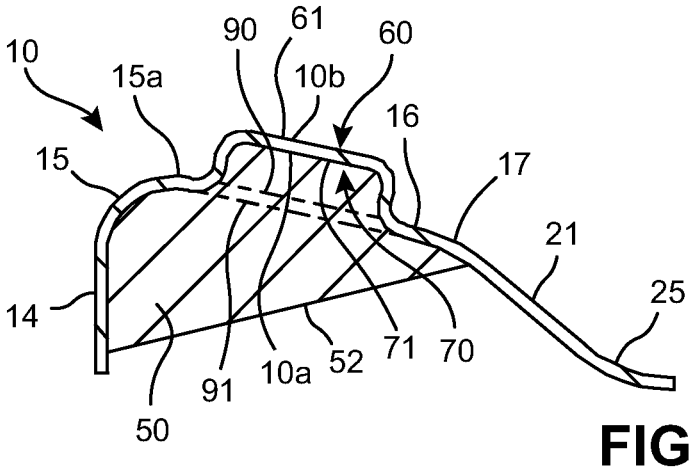
FIG. 9 is an enlarged fragmentary cross-sectional view showing one of the projections/indentations of the lid element of FIG. 8.

Referring now to FIGS. 8 and 9, the lid element 10 having the dimensions suitable for use with the regular mouth canning container 2 is shown again with the addition of an optional torque-limiting feature in the form of an annular array of circumferentially spaced projections 60 formed in the outer face 10*b* of the lid element 10. The projections 60 also facilitate proper venting from the canning container 2 when the lid element 10 is coupled thereto, hence the array of the projections 60 may alternatively be referred to as forming a venting feature of the lid element 10. Although the projections 60 are shown with respect to the lid element 10 as specified herein, it should be readily apparent that the projections 60 may be formed in a lid element of any dimensions while remaining within the scope of the present invention.

The torque-limiting/venting feature is provided to address a potential circumstance wherein a positive pressure formed within the canning container 2 when the lid element 10 is engaging the rim 3 and the retainer element 6 is threaded onto the canning container 2 and engaging the lid element 10 forms an increasing torque within the lid element 10 relative to the retainer element 6 during a canning process. That is, a portion of the positive pressure acting on the central region of the lid element 10 with respect to the exterior axial direction causes the retainer element 6 to act like a fulcrum for causing the peripheral portion 12 to flex in the interior axial direction for compressing the sealing element 50 towards the rim 3 of the canning container 2. If this torque becomes too great, the sealing element 50 may become overly compressed, which prevents additional venting from the interior of the canning container 2 when the contents thereof are being heated during the canning process. This prevention of the venting of the fluids contained within the canning container 2 therefore exacerbates the formation of the internal positive pressure therein. It is accordingly desirable to prevent the formation of such torques and to prevent an incidence wherein the contents of the canning container 2 cannot properly vent past the sealing element 50 of the lid element 10, as such conditions can increase the stresses encountered by the lid element 50 during the canning process while also potentially frustrating the canning process itself due to the lack of proper venting.

The projections 60 are spaced equally in the circumferential direction, thereby resulting in an angular displacement between adjacent ones of the projections 60 also being equal. In the present example, the lid element 10 includes three of the projections 60 spaced 120° from each other angularly with respect to the central axis of the lid element 10. However, any number of the projections 60 may be utilized while maintaining the equal circumferential and angular spacing as disclosed above.

As best shown in FIG. 9, each of the projections 60 extends axially from the outer face 10*b* of the lid element 10 in the exterior axial direction to form a concave surface in the inner face 10*a* and a convex surface in the outer face 10*b*. The formation of each projection 60 in the outer face 10*b* results in the formation of a corresponding indentation 70 in the inner face 10*a*. As shown with reference to FIG. 8, each of the projections 60 may include a substantially rounded rectangular or elliptical perimeter shape, although alternative perimeter shapes may be utilized without departing from the scope of the present invention. Additionally, each of the projections 60 may be formed along the engaging segment 16 of the peripheral portion 12 of the lid element 10. However, the projections 60 may extend at least partially into the adjacent arcuate transition segment 15 and/or the arcuate transition segment 17 with respect to the radial direction without departing from the scope of the present invention, so long as the projections 60 are present within at least a portion of the peripheral portion 12 axially aligned within the underlying sealing element 50.

Each of the projections 60 includes a contact surface 61 forming a distal surface of the peripheral portion 12 with respect to the exterior axial direction configured to engage the radially extending portion 7 of a corresponding retainer element 6 when the retainer element 6 is coupled to the canning container 2. That is, the contact surface 61 of each of the projections 60 forms a surface thereof disposed the farthest in the exterior axial direction relative to the remainder of the peripheral portion 12 to ensure that each of the projections 60 makes contact with the radially extending portion 7 of the retainer 6 instead of any of the segments of the outer face 10*b* of the lid element 10 interposed between adjacent ones of the projections 60. FIG. 9 shows a dashed line 90 corresponding to a configuration of the outer face 10*b* of the lid element 10 along a segment of the peripheral portion 12 circumferentially (angularly) spaced from the position of the illustrated projection 60 to illustrate the manner in which the projection 60 increases the exterior axial extension (projection depth) of the outer face 10*b* therealong to ensure contact with the radially extending portion 7 of the retainer element 6. Each of the contact surfaces 61 may be arranged substantially parallel to the adjacent portions of the engaging segment 16, such as being disposed at the same incline thereas, but each of the contact surfaces 61 may have any orientation and shape without necessarily departing from the scope of the present invention, so long as the contact surfaces 61 are positioned and oriented to make the desired contact with the radially extending portion 7 of the retainer element 6. The projections 60 accordingly form axial spacers disposed circumferentially around the lid element 10 for axially spacing a surface of the radially extending portion 7 facing in the interior axial direction from the outer face 10*b* of the lid element 10, with the exception of the engaging contact surfaces 61 of the circumferentially spaced array of the projections 60.

The corresponding sealing element 50 may be molded onto the lid element 10 following the formation thereof into the configuration including the projections 60, where the shape of the engaging surface 52 may remain the same as that previously described following the molding process of the sealing element 50 to the lid element 10. However, in contrast, an axial thickness of the sealing element 50 may be increased where each of the indentations 70 corresponding to one of the projections 60 is indented axially into the peripheral portion 12 in comparison to a circumferentially spaced segment of the peripheral portion 12 devoid of one of the projections/indentations 60/70 and having the same radial distance from a central axis of the lid element 10. That is, each of the projections/indentations 60/70 may correspond to an increased and maximum axial thickness (depth) of the sealing element 50 when progressing circumferentially around the peripheral portion 12 at a radial distance corresponding to the position of each of the projections/indentations 60/70 from the central axis of the lid element 10. FIG. 9 shows a dashed line 91 corresponding to a configuration of the inner face 10*a* of the lid element 10 along a segment of the peripheral portion 12 circumferentially (angularly) spaced from the position of the illustrated indentation 70 to illustrate the manner in which the indentation 70 increases the thickness (depth) of the sealing element 50 along the corresponding indentation 70.

The increase in the thickness of the sealing element 50 may occur in each of a direction perpendicular to the (inclined) extension of the engaging surface 52 as well as the axial direction of the lid element 10. A base surface 71 of the indentation 70 formed along the inner face 10*a* of the lid element 10 may be arranged substantially parallel to the adjacent portions of the engaging segment 16, but the base surface 71 may have any orientation and shape without necessarily departing from the scope of the present invention.

Figure 10:
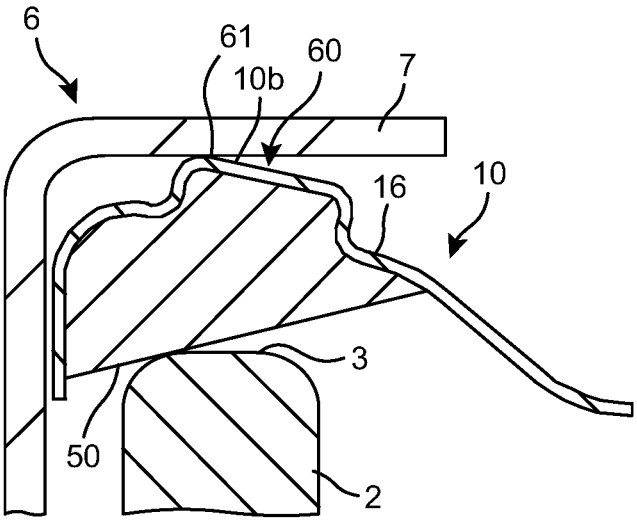
FIG. 10 is an enlarged fragmentary cross-sectional view showing an interaction between a rim of a canning container, a radially extending portion of the retainer element, and one of the projections/indentations of the peripheral portion of the lid element of FIGS. 8 and 9.

With reference now to FIG. 10, the plurality of the projections 60 facilitate the described torque-limiting/venting feature as described hereinafter. The lid element 10 is disposed on the rim 3 of the canning container 2 with the sealing element 50 disposed on the inner face 10*a* of the lid element 10 placed in direct engagement with the rim 3 about the circumference thereof. Next, the retainer element 6 is disposed over the lid element 10 to receive the lid element 10 and the rim 3 of the canning container 2 therein. The retainer element 6 is threaded onto the canning container 2 via mating threads to cause the radially extending portion 7 of the retainer element 6 to approach the peripheral portion 12 of the lid element 10 and the underlying rim 3 of the canning container 2 in the interior axial direction. Because each of the contact surfaces 61 of the projections 60 is distally disposed along the peripheral portion 12 with respect to the exterior axial direction, the radially extending portion 7 of the retainer element 6 will first contact and directly engage each of the contact surfaces 61 when progressing in the interior axial direction towards the rim 3, as shown in FIG. 10. Each of the segments of the peripheral portion 12 interposed circumferentially between adjacent ones of the plurality of the projections 60 is accordingly spaced apart axially from the radially extending portion 7 of the retainer element 6 to cause the contact surfaces 61 of the projections 60 to be the only points of contact between the radially extending portion 7 and the outer face 10*b* of the lid element 10. The equally circumferentially spaced arrangement of the projections 60 also stabilises the assembly of the lid element 10 and the retainer element 6 by ensuring that the lid element 10 is not biased toward any one radial direction when a torque-generating canning process occurs with respect to the assembly of the lid element 10, the retainer element 6, and the canning container 2.

The configuration of the lid element 10 to include the projections 60 as the only surfaces of contact between the peripheral portion 12 of the lid element 10 and the radially extending portion 7 of the retainer element 6 results in the existence of a limited number of potential circumferential positions along the peripheral portion 12 where the radially extending portion 7 can act as a torque-inducing fulcrum. That is, the segments of the peripheral portion 12 interposed between adjacent ones of the projections 60 remain axially spaced from the radially extending portion 7 in a manner wherein no lever-like force is applied directly between the interposed segments of the peripheral portion 12 and the axially aligned segments of the retainer element 6. These interposed segments of the peripheral portion 12 devoid of one of the projections 60 accordingly do not experience as great of an axial force towards the sealing element 50 as those segments of the peripheral portion 12 corresponding to one of the projections 60 when such a lever-like condition occurs during an attempt to vent the interior of the canning container 2 beyond the sealing element 50. Any gases attempting to vent out of the interior of the canning container 2 may accordingly pass by the sealing element 50 along those segments of the peripheral portion 12 interposed between adjacent ones of the projections 60 due to this lessened force present between the rim 3 of the canning container 2 and the sealing element 50 along such segments.

The annular array of the indentations 70 may also prevent the above-described formation of torque within the lid element 10 by increasing the sealing depth of the sealing element 50 at the location of each of the indentations 70 in comparison to the sealing depth of the circumferentially (angularly) spaced segments of the sealing element 50 not aligned with one of the indentations 70. This increased sealing depth may result in the sealing element 50 being compressively strained at positions in axial alignment with each of the indentations 70 to a lesser extent, as a percentage of axial depth, than would be the portions of the sealing element 50 not placed in axial alignment with one of the indentations 70, when subjected to similar axial forces. This may result in a decreased reaction force exerted by the sealing element 50 towards the rim 3 as a result of the compression of the sealing element 50 between the rim 3 and the peripheral portion 12 of the lid element 10. This effect may prevent the sealing element 50 from becoming excessively compressed towards the peripheral portion 12 at the locations having one of the indentations 70. The prevention of this over-compression of the sealing element 50 at each of the indentations 70 may allow venting to occur past the sealing element 50 to prevent the continued increase of pressure within the canning container 2, thereby preventing the lid element 10 from being subjected to a torque causing a deformation or buckling thereof.

The manner in which each of the projections 60 and corresponding indentations 70 is provided as a deformation of the peripheral portion 12 into a rib-like structure may also result in the lid element 10 having a greater resistance to bending adjacent each of the projections/indentations 60/70, each of which may act as a form of reinforcing structure of the lid element 10. Any excessive forces acting on the projections 60 may accordingly be accommodated by the resistance of the lid element 10 to bending deformation at and adjacent each of the projections 60.

It should also be understood that the present invention is not necessarily limited to the disclosed dimensions of either of the lid elements 10, 110, and can be easily adapted for use with canning containers of alternative dimensions while maintaining the same general relationships disclosed herein. Such embodiments may include the lid element having a peripheral portion 12 occupying a radial extension of about 10-14% of the total radial extension of the lid element, a channel portion 20 occupying a radial extension of about 17-21% of the total radial extension of the lid element, and a domed portion 30 occupying a radial extension of about 67-71% of the total radial extension of the lid element. The lid element may further include the planar segment 22 thereof occupying a radial extension of about 40-50% of the radial extension of the corresponding channel portion 20 and about 7-10% of the total radial extension of the lid element. The domed portion 30 may also be selected to include an axial height that is greater than an axial height of the adjacent inner angled segment 23 of the channel portion 20, and this axial height of the domed portion 30 may be selected to be at least twice as great as that of the inner angled portion 23.

It should further be understood that the advantageous torque-limiting/venting feature provided by the array of the projections 60 may be utilized in a lid element having a differing configuration from those disclosed herein. That is, the advantage of the described torque-limiting/venting feature may be apparent even where the remainder of the lid element disposed radially inwardly of the peripheral portion thereof includes a contrary construction that does not facilitate other advantages of the present invention disclosed herein, including a contrary configuration of a corresponding channel portion and domed portion thereof.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A lid assembly for use with a canning container having a rim and a retainer element having a radially extending portion, the lid assembly comprising:

a lid element having an annularly shaped peripheral portion configured to be axially aligned with and disposed between the rim of the canning container and the radially extending portion of the retainer element when the lid assembly is engaging the canning container and the retainer element is removably coupled to the canning container; and an annularly shaped sealing element disposed on the peripheral portion of the lid element and configured to directly engage the rim of the canning container when the lid assembly is contacting the canning container, wherein a plurality of projections is formed in the peripheral portion of the lid element with each of the projections forming a distally disposed surface of the peripheral portion with respect to an exterior axial direction of the lid element extending away from an interior of the canning container when the lid assembly is engaging the rim.

2. The lid assembly of claim 1, wherein the projections are equally circumferentially spaced about a circumference of the peripheral portion.

3. The lid assembly of claim 2, wherein the plurality of the projections includes three of the projections angularly displaced from each other by 120° relative to a central axis of the lid element.

4. The lid assembly of claim 1, wherein each of the projections is configured to directly engage the radially extending portion of the retainer element when the retainer element is removably coupled to the canning container.

5. The lid assembly of claim 4, wherein each of a plurality of segments of the peripheral portion interposed circumferentially between adjacent ones of the projections is axially spaced apart from the radially extending portion of the retainer element when the retainer element is removably coupled to the canning container.

6. The lid assembly of claim 1, wherein each of the projections corresponds to an indentation indented into the lid element in the exterior axial direction.

7. The lid assembly of claim 6, wherein a sealing depth of the sealing element along each of the indentations is different from a sealing depth of the sealing element along each of a plurality of segments of the peripheral portion interposed circumferentially between adjacent ones of the plurality of the projections.

8. The lid assembly of claim 7, wherein the sealing depth of the sealing element along each of the indentations is greater than the sealing depth of the sealing element along each of the plurality of segments of the peripheral portion interposed circumferentially between adjacent ones of the plurality of the projections.

9. The lid assembly of claim 6, wherein each of the projections includes a convex surface and each of the indentations includes a concave surface.

10. The lid assembly of claim 1, wherein the lid element further includes a centrally disposed domed portion and an annular channel portion disposed radially outwardly of the domed portion and radially inwardly of the peripheral portion.

11. The lid element of claim 10, wherein at least a portion of the channel portion extends axially beyond an entirety of the peripheral portion with respect to an interior axial direction towards the interior of the canning container when the lid assembly is engaging the rim.

12. The lid element of claim 11, wherein the at least a portion of the channel portion includes a planar segment of the channel portion.

13. The lid element of claim 1, wherein the peripheral portion includes an engaging segment extending at least partially in the radial direction of the lid element, wherein each of the projections projects from the engaging segment of the peripheral portion.

14. The lid element of claim 13, wherein the engaging segment is inclined relative to a radial direction of the lid element.

15. A lid assembly for use with a canning container having a rim and a retainer element having a radially extending portion, the lid assembly comprising:

a lid element including:

a centrally disposed domed portion;

an annular channel portion disposed radially outwardly of the domed portion;

an annularly shaped peripheral portion disposed radially outwardly of the channel portion, the peripheral portion configured to be axially aligned with and disposed between the rim of the canning container and the radially extending portion of the retainer element when the lid assembly is engaging the canning container and the retainer element is removably coupled to the canning container; and an annularly shaped sealing element disposed on the peripheral portion of the lid element and configured to directly engage the rim of the canning container when the lid assembly is contacting the canning container, wherein a plurality of projections is formed in the peripheral portion of the lid element with each of the projections forming a distally disposed surface of the peripheral portion with respect to an exterior axial direction of the lid element extending away from an interior of the canning container when the lid assembly is engaging the rim, wherein each of the projections is configured to directly engage the radially extending portion of the retainer element when the retainer element is removably coupled to the canning container, and wherein each of a plurality of segments of the peripheral portion interposed circumferentially between adjacent ones of the projections is axially spaced apart from the radially extending portion of the retainer element when the retainer element is removably coupled to the canning container.

16. A canning container assembly comprising:

a canning container having a rim;

a retainer element configured to be removably coupled to the canning container, the retainer element including a radially extending portion;

a lid element having an annularly shaped peripheral portion configured to be axially aligned with and disposed between the rim of the canning container and the radially extending portion of the retainer element when the retainer element is removably coupled to the canning container; and an annularly shaped sealing element disposed on the peripheral portion of the lid element and configured to directly engage the rim of the canning container, wherein a plurality of projections is formed in the peripheral portion of the lid element with each of the projections forming a distally disposed surface of the peripheral portion with respect to an exterior axial direction of the lid element extending away from an interior of the canning container and towards the radially extending portion of the retainer element when the retainer element is removably coupled to the canning container.

* * * * *